US008465382B2

(12) United States Patent
Moye

(10) Patent No.: US 8,465,382 B2
(45) Date of Patent: Jun. 18, 2013

(54) ELECTRONIC BASKETBALL SHOOTING COACH

(76) Inventor: Rashan Christopher Moye, Phoenix, AZ (US)

( * ) Notice: Subject to any disclaimer, the term of this patent is extended or adjusted under 35 U.S.C. 154(b) by 188 days.

(21) Appl. No.: 12/925,507

(22) Filed: Oct. 23, 2010

(65) Prior Publication Data

US 2011/0045925 A1 Feb. 24, 2011

Related U.S. Application Data

(63) Continuation-in-part of application No. 12/218,326, filed on Jul. 14, 2008, now abandoned.

(60) Provisional application No. 61/130,508, filed on Jun. 2, 2008.

(51) Int. Cl.
*A63B 69/00* (2006.01)

(52) U.S. Cl.
USPC ..... 473/450; 473/422; 473/447; 473/458

(58) Field of Classification Search
USPC ..... 473/422, 450, 458, 464, 447, 212–214, 473/220, 224, 221; 434/247–257; 463/48, 463/36, 37
See application file for complete search history.

(56) References Cited

U.S. PATENT DOCUMENTS 3,860,245 A * 1/1975 Yamada ..... 473/213
4,699,379 A * 10/1987 Chateau et al. ..... 473/59
4,805,905 A * 2/1989 Haub ..... 473/450
5,135,217 A * 8/1992 Swain ..... 473/450
5,149,085 A * 9/1992 Sanchez ..... 473/450
5,236,190 A * 8/1993 Moss ..... 473/450
5,300,921 A * 4/1994 Hoch et al. ..... 473/464
6,487,906 B1 * 12/2002 Hock ..... 73/379.01
6,918,844 B2 * 7/2005 Socci ..... 473/458
7,854,668 B2 * 12/2010 Shelton ..... 473/450
8,043,173 B2 * 10/2011 Menalagha et al. ..... 473/464
2006/0057549 A1 * 3/2006 Prinzel et al. ..... 434/247
2007/0066415 A1 * 3/2007 Hou et al. ..... 473/219
2007/0219025 A1 * 9/2007 Aberton et al. ..... 473/450
2009/0298621 A1 * 12/2009 Moye ..... 473/450

* cited by examiner

*Primary Examiner* — Mitra Aryanpour

(57) ABSTRACT

An Electronic Basketball Shooting Coach device is used to recondition the mind helping people maintain the proper elbow angle range when shooting a basketball. The self-contained device is worn on either arm below the elbow of a user. The ergonomically designed device is contained in the specially designed pocket of the sleeve before it can be attached below the elbow. The sleeve wraps around the upper-arm below the elbow and is held in place by hook-and-loop materials. The device has no internal movable parts. The device will articulate a phrase when the programmed non-adjustable trip point range. The device has a sleep mode to save on the common single cell's power and is reactivated by movement. The non-adjustable knob must be positioned up towards the fingers and aligned with the thumb or little finger. Two single cell sources must be added to energize the invention.

10 Claims, 3 Drawing Sheets

ELECTRONIC BASKETBALL SHOOTING COACH

CROSS REFERENCE TO RELATED APPLICATIONS

This CIP application claims the benefit of provisional patent application Ser. No. 61/130,508, filed 2008 Jun. 2 and of Ser. No. 12/218,326, filed 2008 Jul. 14 now abandoned by the present inventor, which is incorporated by reference.

FEDERALLY SPONSORED RESEARCH

None

SEQUENCE LISTING

None

BACKGROUND OF THE INVENTION

1. Field of Invention

The present invention relates to a basketball shooting aid, and more specifically, to a basketball shooting aid which trains people on how to properly shoot a basketball.

2. Prior Art

There is a right way and a wrong way to everything including shooting a basketball. When people learn how to shoot a basketball, usually as kids, they develop improper shooting skills in order to throw a basketball toward the basketball rim. They either throw the basketball under hand or over hand like a shot-putter.

A lot of coaches and parents allow kids to shoot a basketball the wrong way because they probably don't know that there is a proper way to shoot a basketball. So millions of kids are spending thousands of hours practicing how to shoot a basketball, which is good, but it is the wrong way, which is bad. This bad form of shooting a basketball then follows the kid into adulthood.

Just because you are looking at the basketball rim doesn't mean that the basketball will automatically go there. You need the help of your arms to help the basketball reach the place you want it to go. However, the problem is when people shoot a basketball their elbow comes away from the side of their body and it causes the forearm to move from a straight up position to a slanted position; it can be compared to a bird wing when it flaps out. When people shoot with their elbow out there is no consistency in their shot because the elbow will move to a different spot every time someone shoots the basketball. In the past, the only way to fix the bad form problem was to hire a professional basketball shooting coach but many people cannot afford this solution.

Previously, inventors have created several types of basketball shooting aids in such a way to help people learn how to shoot a basketball. U.S. Pat. No. 6,645,093 to Sheppard (2003) which discloses an arm bar which holds the shooter's arm in a desired position by means of a back plate; however, this can add unwanted weight to a shooter which could cause them to overshoot the rim when the device is not being worn. U.S. Pat. No. 6,758,768 to Spencer (2004) discloses an apparatus with a bull's eye mounted behind a backboard that gives the shooter something to target while shooting. If the shooter aims the basketball towards the bull's eye they will hit the backboard and make the shot but this device replaces the teaching of using the box that is already placed on all backboards and this device doesn't teach the proper form when shooting. People can bend their bodies any way they have to just to get the basketball up in the air to try and hit the bull's eye but proper form is still lacking. Again, just because you are looking at a basketball rim or at a basketball backboard does not mean that the basketball will automatically go there when you shoot it.

U.S. Pat. No. 7,041,015 to Sowders (2006) teaches an individual proper technique when shooting by the way an individual grips the basketball and with the release of the basketball. An equatorial track shows if the ball was shot properly by the way the track falls. This device would work well if that is the only way you could release a basketball but an individual should be ready to shoot when the ball reaches the hands and they may not have time to line up the equatorial track in a basketball game.

All these devices are either too restricting to the shooting arm or do not focus in on the technique of properly shooting a basketball. Thus, there is a need and there has never been disclosed a basketball shooting aid which will help people learn the proper way to shoot a basketball. The Electronic Basketball Shooting Coach will improve an individual's ability to put the ball in the hoop and will be an exciting and awesome educational device for kids of all ages.

SUMMARY OF THE INVENTION

When you shoot the basketball if your elbow comes away from the side of your body then the upper-arm will go from a perpendicular position to a slanted position causing the direction of the basketball to change. The present device relates to a uniquely designed device that helps people of all ages maintain the proper elbow angle when shooting a basketball. The device is called The Electronic Basketball Shooting Coach.

The present invention resolves a long need for a low-cost, high tech, uncomplicated basketball training aid. When you shoot a basketball, the goal is to first face the basketball rim. With the basketball in the hands, the forearms should come up and be extending straight out towards the front of the body forming a 90-degree angle with the upper arm and lower arm. You want to keep the elbow tucked to your side and follow through keeping that same 90-degree angle position until you release the basketball.

The device is a self-contained unit. The casing for the device is ergonomically designed to best accommodate human performance and behavior while reducing discomfort. The device's shape helps it fit effectively around the muscles surrounding the ulna and radius bone below the elbow, which refers to the region surrounding the joint connecting the upper arm to the lower arm below the elbow. The device was also designed to fit around the muscles surrounding the ulna and radius bone below the elbow, which refers to the region surrounding the joint connecting the upper arm to the lower arm, to give a more effective reading to the user. The shape of the device will also minimize the effect the upper arm muscles will have on the device readings. The device can be placed on either the right or left upper arm below the elbow; it will be determined by which hand the individual shoots with. The device will not be placed on the wrist or the bicep but on the muscles surrounding the ulna and radius bone below the elbow, which refers to the region surrounding the joint connecting the upper arm to the lower arm below the elbow. The casing for the invention can be made of two identical halves that will be connected and held together by screws. The casing can be made of but not limited to an acrylonitrile butadiene styrene (also called ABS) plastic, which has good impact strength, satisfactory stiffness and dimensional stability, glossy surface and is easy to machine. The casing can also be made out of any lightweight material so not too much weight is added to the shooter's arm. Too much weight can cause the shooter problems when the device is not on the arm. The casing will have an audio enhancement/speaker grille to help increase the hearing for the user. The back of the device will have a removable back plate so the two common single cells producing an electric current can be inserted. The invention will work when the individual using the product inserts two common single cells producing an electric current into the two common single cell holding means. The common single cells producing an electric current will not come affixed to the device.

The inside of the casing is formed of a lightweight material such as but not limited to acrylonitrile butadiene styrene (ABS), the casing includes a space for a non-adjustable knob cavity and an On and Off switch cavity and two common single cell holders. Connected to the circuit board is a sound enhancer, four common single cells contact terminals, an IC Voice Chip, a Microcontroller chip located on the circuit board, an ON and Off switch, an Angle Sensor chip located on the circuit board, and a non-adjustable knob. The device can also be made without the non-adjustable knob.

The device will be contained inside a specially designed form-fitting pocket made of a, but not limited to, sack or other cloth like fabric attached to the sleeve. Other fabrics may include, but not limited to, wool, silk, linen, acetate, latex, nylon, polyester, rayon, or spandex. Once the device is placed inside of the pocket then the pocket lid, made of the same material, will be pulled down and locked using VELCRO (hook and loop material). Once the pocket lid is locked, it will hold the device in place. The sleeve is made up of two identical sized pieces of stretchy material that is connected to the pocket on one end and connected to identical sized pieces of VELCRO (hook-and-loop material on the other end). The stretchy material allows the sleeve to be adjusted to the upper forearm of the user. To give a better description of the sleeve, from right to left, is VELCRO (hook and loop material), stretchy material, the containing pocket, stretchy material, VELCRO (hook and loop material). You fasten the sleeve, with the device contained in the pocket, around the muscles surrounding the ulna and radius bone below the elbow, which refers to the region surrounding the joint connecting the upper arm, to the lower arm. You will fasten it by pulling one end of the sleeve to the other end of the sleeve connecting the VELCRO (hook and loop material) together. The device cannot be attached to the user's upper forearm below the elbow unless it is contained inside the specially designed sleeve pocket.

The device uses Chip On Board technology or C.O.B., which refers to the microchip being directly mounted on and electrically interconnected to its final Circuit Board, instead of being packaged as an individual IC. It simplifies the overall process of designing and manufacturing the final product, as well as improves its performance as a result of the shorter interconnection paths. This will reduced space requirements, reduced cost, provide better performance due to decreased interconnection lengths and resistances, provide higher reliability due to better heat distribution and a lower number of solder joints, shorter time-to-market, and better protection against reverse-engineering or trying to make a new device or program that does the same thing.

A printed Circuit Board, which is used to mechanically support and electrically connect electronic components using conductive pathways, tracks or traces etched from copper sheets laminated onto a non-conductive substrate. It can also be called a printed on but not limited to a wiring board or etched wiring board. Circuit Boards consist of an insulator with threads of conductive material serving as wires on the base of the board. The insulator may consist of one or numerous layers of material glued into a single entity. These additional layers may serve a number of purposes, including providing grounding to the board. Circuit boards are inexpensive, and are highly reliable.

Attached to the Circuit Board is a Microcontroller Chip also called a MCU chip, which is a small computer on a single integrated circuit with a complex set of electronic components and their interconnections that are etched or imprinted onto a tiny slice of semiconducting material. The Microcontroller chip contains a processor core, memory, and programmable input/output peripherals giving the unit the ability to communicate with the user. The program memory is in the form of a NOR flash meaning the computer chip has read-only memory that retains its data when the power is turned off and that can be electronically erased and reprogrammed without being removed from the circuit board and is also often included on chip, as well as a typically small amount of RAM. The Microcontroller will be programmed to fit the need of the operation. Attached to the circuit board is an IC voice chip, which gives the unit a true voice.

The Angle Sensor chip is connected to the Circuit Board and allows for accurate measurement of angles. The Angle Sensor chip is configured for the exact measurement range required, giving the angle sensor chip the highest possible accuracy over the measurement range. The Angle Sensor chip also incorporates advanced automatic low-power modes with auto-wake and auto-sleep. The three modes of operation, off, standby and active, offer different capabilities for power conservation applications. Sleep mode saves power and detection of a shake, a change in tilt angle or a change in orientation will initiate auto wake to bring the Angle Sensor back to full active mode. The invention has no internal moving parts, ideal for applications subject to extreme environments where grime, moisture and vibration are factors. Microcontroller chip and the Angle Sensor chip Work together to calculate the exact angle when you fix the original angle. The Microcontroller chip and the Angle Sensor chip will be programmed to regulate how sensitive when the user goes beyond the trip point. Connected to the Circuit Board with wires is the speaker that allows the voice to be heard by the user.

In the preferred method the device is pre-programmed. To use the above described device, an individual will insert the Electronic Basketball Shooting Coach device inside the form fitting pocket that is specially designed for the Electronic Basketball Shooting Coach device. With the device contained inside the form fitting pocket, the user will fasten the sleeve around the muscles surrounding the ulna and radius muscles below the elbow, which refers to the region surrounding the joint connecting the upper arm to the lower arm below the elbow by pulling one end of the sleeve to the other end of the sleeve using VELCRO (hook-and-loop material). Once done, the device will be held firmly to the muscles surrounding the ulna and radius bone below the elbow, which refers to the region surrounding the joint connecting the upper arm to the lower arm below the elbow.

The ON and OFF switch located on the device must be positioned towards the ground. The non-adjustable knob located on the device must be positioned up towards the fingers and be aligned with the little finger often called the pinky finger thumb for right-handed basketball shooters. The device should be aligned with the thumb for left-handed basketball shooters. Once the device is secure on the individual's muscles surrounding the ulna and radius bone below the elbow, which refers to the region surrounding the joint connecting the upper arm to the lower arm below the elbow it, can be turned ON using the ON switch located on the outside lower end of the casing. Once the device is in the ON position the individual is ready to begin using the device.

The individual should just relax the arm making it parallel to the body. Then while facing the basketball rim the user should get ready to receive a basketball; either by picking it up or by having someone toss it to them. Once the basketball is in the individual's hand, the individual should keep his or her elbow tucked close to the side of their body while making sure the upper arm and the bicep are forming a 90-degree angle. The user should just shoot as normal remembering to release the ball at its highest point. The user will keep the elbow tucked close to the side of the body because that is the common method for keeping the forearm perpendicular when shooting a basketball. However, if the elbow moves away from the side of the body then the elbow angle will automatically slant, moving to the left or right depending on the arm the individual has the device on. The Microcontroller chip and the Angle Sensor will work together to calculate how far off the user's elbow angle is from the original pre-programmed angle. When the basketball player's shooting elbow angle goes past the pre-programmed trip point range then the IC Voice Chip will cause the device to articulate the phase "keep your elbow tucked in". The unit is not limited to previously mentioned phrase but any phase can be used. If the unit is idle for a few minutes then it will go to a sleep mode to save power. It can be brought bake to full operations by shaking the device.

In another embodiment the trip point for the device is pre-programmed, the Microcontroller chip and Angle Sensor chip can be set by the individual using the device. The user of the device will place the device inside the form-fitting pocket of the sleeve. With the device contained in the form fitting pocket, the user will be fasten the sleeve around the muscles surrounding the ulna and radius bone below the elbow, which refers to the region surrounding the joint connecting the upper arm to the lower arm below the elbow. This is done by pulling one end of the sleeve to the other end of the sleeve using VELCRO (hook-and-loop material). The non-controllable knob must be positioned up towards the fingers and be aligned with the thumb or little finger often called the pinky finger. The user will then turn the device ON and go through their normal and natural shooting form one time. Once the user has gone through their shooting form one time they will press a recorder button and the device will be programmed and will remember the user's normal and natural shooting form. That will become the programmed starting point and is not changed unless reprogrammed by the user. Although there is a new programmed starting point, when the user elbow angle deviates outside the programmed trip point range (i.e. 40 degrees) then the unit will articulate the phrase "keep your elbow tucked in". The unit is not limited to previously mentioned phrase but any phrase can be used. The pre-programmed angle trip point range will always be the same no matter the starting point of the user.

In another embodiment, once the device is placed on the muscles surrounding the ulna and radius bone below the elbow, which refers to the region surrounding the joint connecting the upper arm to the lower arm below the elbow, the device will be programmed to count the number of shot attempts that are made by the user. When the numbers of attempts are reached, the device will articulate to the user the number of times they went past the trip point and the number of times they didn't go past the trip point, as well as the percentage of the previously mentioned.

Although the description above contains specificities, these should not be construed as limiting the scope of the invention but as merely providing illustrations of some of the presently preferred embodiments of this invention. For example, the Electronic Basketball Shooting Coach can have other shapes such as a triangle and be used for other sports.

CONCLUSION, RAMIFICATIONS, AND SCOPE

Accordingly, the reader will see that the basketball shooting coach of this invention can be used to improve an individual's technique for shooting a basketball. The basketball shooting coach can be easily applied and removed from an individual's forearm, is simple to use, and is light enough so it doesn't add any extra weight to the individual's arm while shooting. The alarm also makes it easy for the individual to know when they are shooting improperly.

Although the description above contains specificities, these should not be construed as limiting the scope of the invention but as merely providing illustrations of some of the presently preferred embodiments of this invention. For example, the basketball shooting coach can have other shapes such as an oval, triangle; and also be designed with a digital number indicator that is placed on the outside of the invention to keep track of the total good and bad shots taken with the aid.

Thus the scope of the invention should be determined by the appended claims and their equivalents, rather than by the examples given.

REFERENCE NUMERALS

10: is the overall Electronic Basketball Shooting Coach device.

12: is the electronic device case.

14: is the pocket.

15: is the stretch band.

16: is the sleeve.

17: VELCRO (hook-and-loop attachment).

18: is the audio enhancement/speaker opening.

20: The muscles surrounding the ulna and radius muscles below the elbow, which refers to the region surrounding the joint connecting the upper arm to the lower arm below the elbow.

22: is the basketball.

24: is the vertical line delineating the desired position of the shooters arm.

24*a*: is the angled line indicating an undesirable position of the shooters arm.

26: is the audio enhancement/speaker.

28: are the speaker openings.

30: is the front component

32: is the back component

34: is the cover.

36: is the on-off switch.

38: is the preset non-adjustment knob.

40: is the scale of preset adjustment 38.
42: is the printed Circuit Board.
44: are the common single cells holding means.
46: are the common single cells producing an electric current.
48: are the common single cell clearance openings.
50: are the common single cells contact terminals.
52: are the screws.
54: are the screw holders.
56: is the pre-programmed Angle Sensor.
58: is the pre-programmed IC Voice chip.
60: is the pre-programmed Microcontroller chip.

DESCRIPTION OF THE PREFERRED EMBODIMENT

Figure 1:
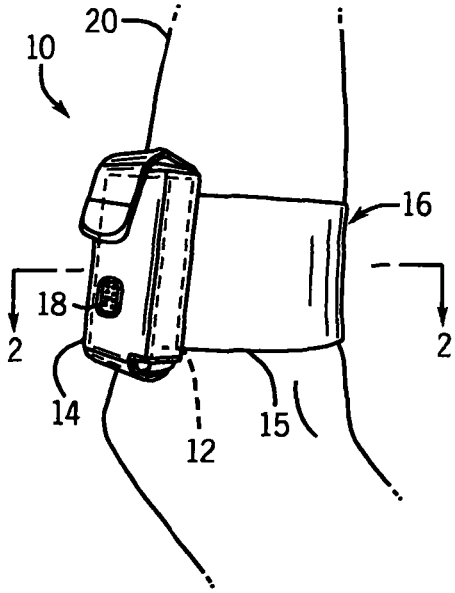
FIG. 1: is a perspective view of the invention in use.

FIG. 1 is a perspective view of the invention 10. The invention 10 is held in a specially designed pocket 14. The pocket 14 has a lid that has VELCRO (hook-and-loop material) 17 that help lock the device in place. The pocket 14 is connected to a sleeve 16 with, but not limited to, threading material. The two pieces, the pocket 14 and sleeve 16, are stitched together and become one unit. The pocket 14 is made with an audio enhancement/speaker opening 18 that is lined up with the audio enhancement/speaker 26 of the device 10. The sleeve 16 of the invention 10 is, from right to left, designed with VELCRO (hook-and-loop material) 17, stretchy band 15, pocket 14, stretchy band 15, VELCRO (hook and loop material) 17. The sleeve 16 wraps around the forearm 20 of the user and is held in place and tightened to comfort by connecting the VELCRO (hook and loop material0 17 once it is put around the muscles surrounding the ulna and radius muscles below the elbow, which refers to the region surrounding the joint connecting the upper arm to the lower arm 20.

Figure 2:
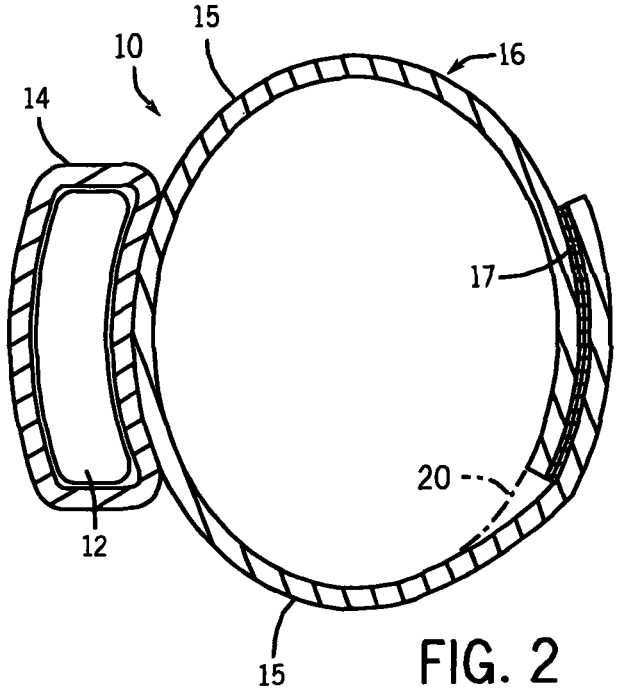
FIG. 2: is a cross-sectional view, taken on line 2-2 of FIG. 1.

FIG. 2 is a cross-sectional view, taken on line 2-2 of FIG. 1, illustrating the strap 16 wrapped around the muscles surrounding the ulna and radius muscles below the elbow, which refers to the region surrounding the joint connecting the upper arm to the lower arm 20. The strap 16 can be easily adjusted to fit the muscles surrounding the ulna and radius muscles below the elbow, which refers to the region surrounding the joint connecting the upper arm to the lower arm 20 of the individual. The casing 12 is oval and ergonomically design to fit around the ulna and radius bone located inside the region surrounding the joint connecting the upper arm to the lower arm below the elbow 20. The casing 12 is constructed of a light-weight, but not limited to, ABS plastic. The sleeve 16 is constructed of VELCRO (hook and loop material) 17, stretchy band 15, the pocket 14, stretchy band 15, then VELCRO (hook and loop material) 17.

Figure 3B:
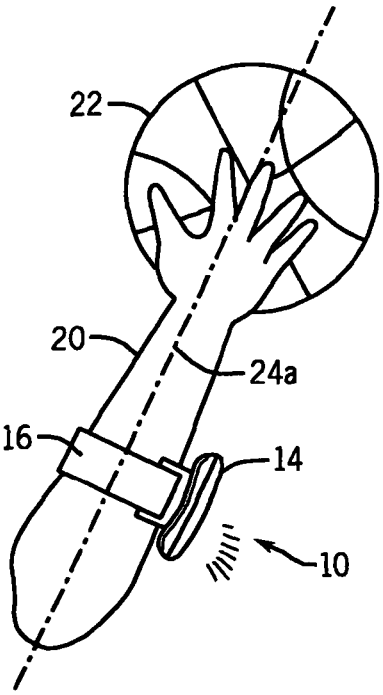
FIG. 3B: is an elevation view of the invention in use, similar to FIG. 3A.
Figure 3A:
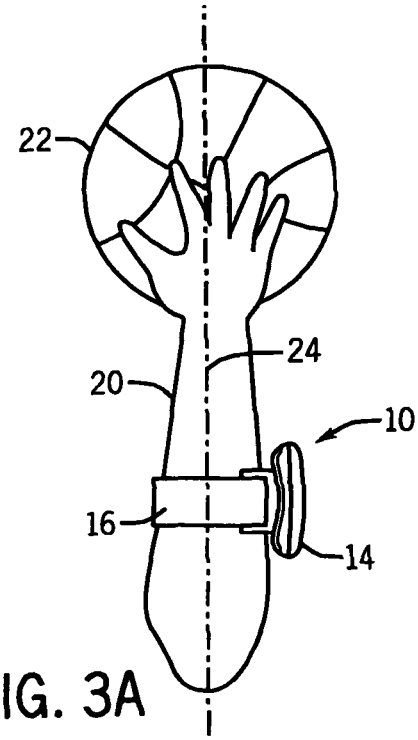
FIG. 3A: is an elevation view of the invention in use.

FIG. 3A: is an elevation view of the overall Electronic Basketball Shooting Coach device 10. FIG. 3A is similar to FIG. 3B. It is a cut-away top view of the device illustrating the sleeve 16 wrapped around the region surrounding the joint connecting the upper arm to the lower arm below the elbow 20. The vertical line delineating the desired position of the basketball players arm 24 while shooting a basketball 22. The picture also shows that if the device is being used properly it will keep the elbow angle range within the pre-programmed trip point range and the articulated phrase will not be triggered.

FIG. 3B: is an elevation view of the overall Electronic Basketball Shooting Coach device 10. in use FIG. 3B is similar to FIG. 3A. It is a cut-away top view of the device illustrating the sleeve 16 wrapped around The muscles surrounding the ulna and radius muscles below the elbow, which refers to the region surrounding the joint connecting the upper arm to the lower arm below the elbow 20. The angled line is indicating an undesirable position of the basketball player's arm 24 while shooting a basketball 22. The picture also shows that if the device is being used properly and the elbow angle range falls outside of the pre-programmed trip point range and the articulated phrase will be triggered verbally telling the basketball player to "keep your elbow tucked in".

Figure 4:
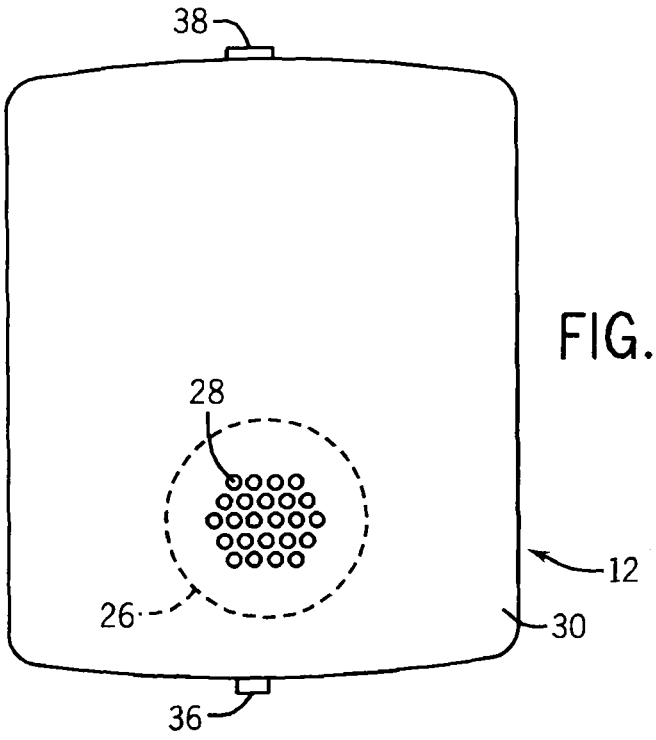
FIG. 4: is a front view.

FIG. 4: is a front view of the device 10. At the top of the device 10 is the pre-set non-adjustment knob 38. The casing 12 is made of an ABS light-weight plastic. 30 is the front component of the device. 26 is the audio enhancement/speaker and 28 are the holes that are in the casing 12 for the audio enhancement/speaker 26, which will increase the volume of the unit. At the lower end of the invention 10 is the On and Off switch 36.

Figure 5:
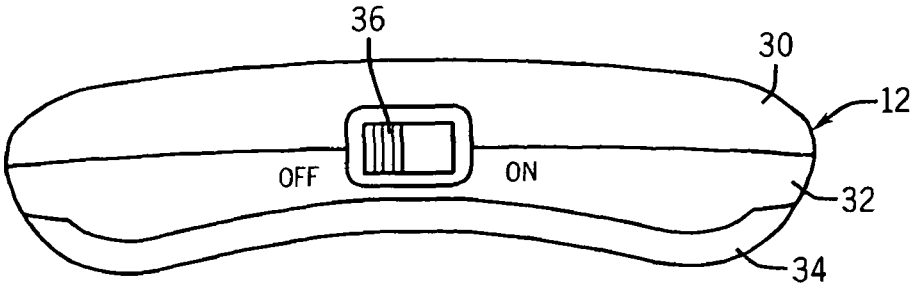
FIG. 5: is an end view.

FIG. 5: is an end view. It shows the On and Off switch 36. The casing 12 is made up of two halves. 30 shows the front half of the device 10 and 32 shows the back half of invention 10. 34 shows the removable back cover for the invention 10.

Figure 6:
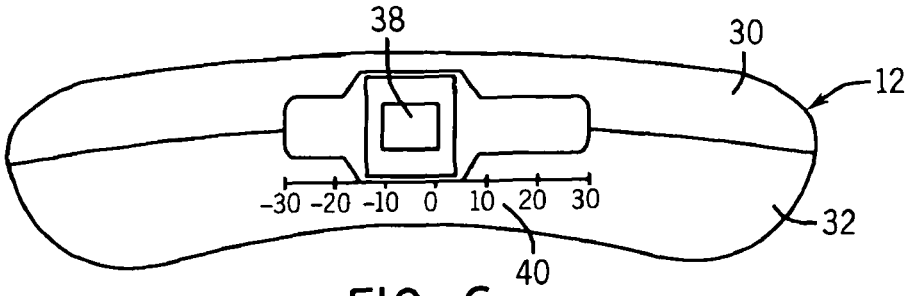
FIG. 6: is the other end view.

FIG. 6: is the other end view. The figure shows the casing 12. The casing 12 is made up of two halves. 30 shows the front component of the device 10 and 32 shows the back component on the device 10. 38 is the pre-programmed non-adjustment knob 38 and 40 is the scale of pre-set adjustment.

Figures 7, 8:
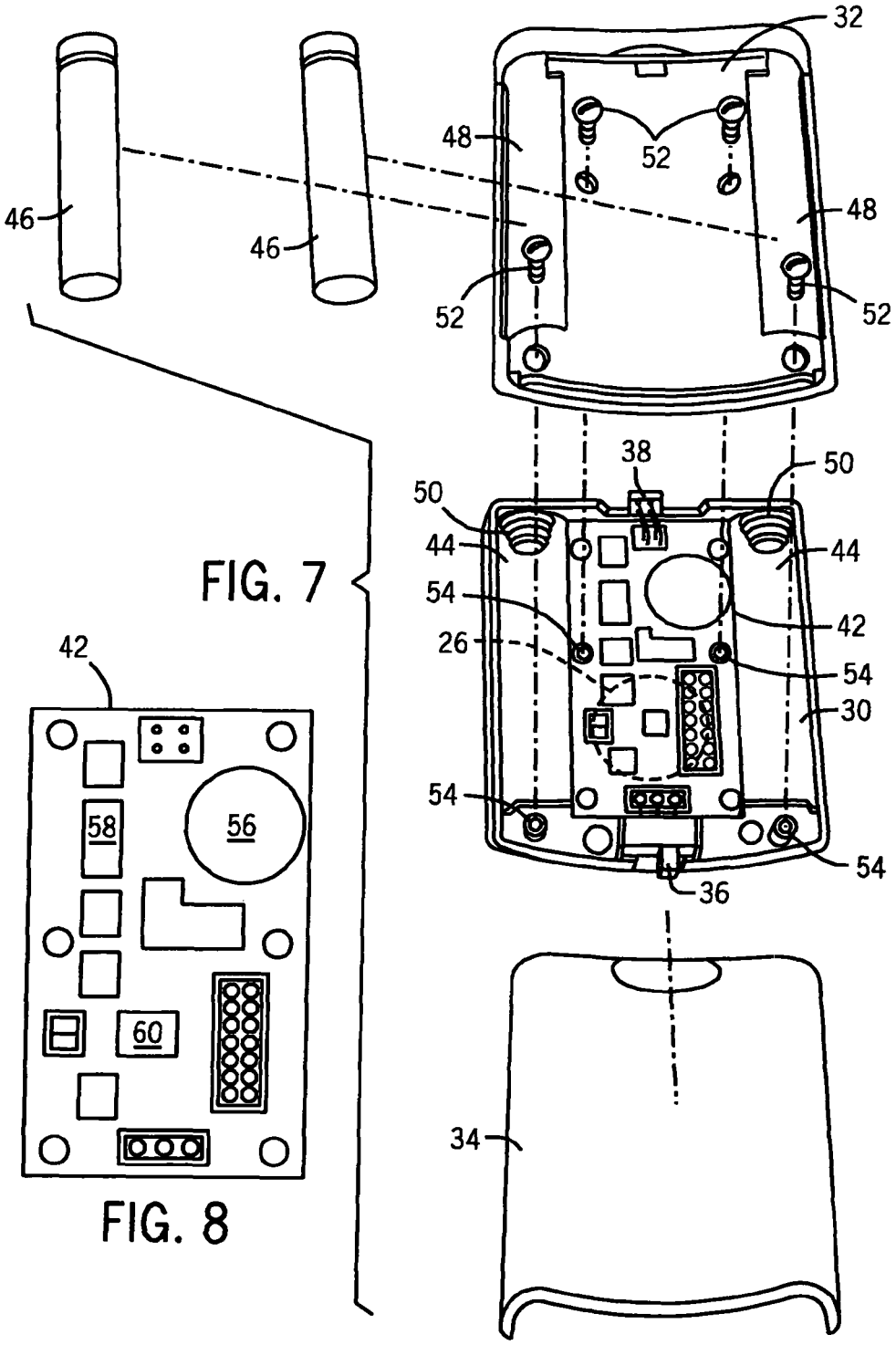
FIG. 7: is an exploded view.
FIG. 8: is a detail plan view of the printed circuit board.

FIG. 7: is an exploded view. The device 10 is powered by two common single cells producing an electric current 46, which are not included in the device 10. Two common single cell clearance openings 48 are molded in the casing 12. You place the 2 common single cells producing an electric current 46 through the common single cell clearance openings 48 so it fits in the common single cell holding means 44 in order to activate the device 10. The back component 32 of the device 10 is screwed and held in place with screws 52. In the middle picture you can see the device 10 as if the back component 32 was removed. You must place the two common single cells producing an electric current 46 in the common single cell holding means 44. You put the negative side of the common single cells producing an electric current 46 against the common single cells contact terminals 50 and the positive end of the common single cells producing an electric current 46 will fall right into place against the single cells contact terminals 50. The device 10 is activated with an ON and OFF switch 36 located at the bottom of the device. When the device 10 is activated the user is ready to begin using it. Inside the device 10 is a circuit board 42 that is pre-programmed to recognize when the trip point range is passed. At the top of the invention is a pre-programmed non-adjustable knob 38, which is connected to the circuit board 42. Underneath of the circuit board 42 is the audio enhancement/speaker 26. The back plate 32 is connected to front component 30 and the screws 52 hold the back plate 32 to the front component 30. The screws 52 are tightened and held into place by the screw holders 54. Once the two halves are connected and secured with screws 52 the cover 34 is put into place and shields the inside of the device 10.

FIG. 8: is a detail plan view of the printed Circuit Board 42. On the Circuit Board 42 are the 56 pre-programmed Angle Sensor, 58 the pre-programmed IC Voice chip, and the 60 pre-programmed Microcontroller chip programmed. The pre-programmed Microcontroller chip 60 and the pre-programmed Angle Sensor work together and when the user passes the trip point the pre-programmed IC Voice Chip 58 will articulate the phrase (i.e. "keep your elbow tucked in").

I claim:

1. A self-contained basketball shooting coach training device for maintaining proper elbow angle while shooting a basketball comprising:

a flexible sleeve positioned on an arm below a user's elbow;

a pocket attached to said sleeve;

a casing positioned within said pocket, said casing having a plurality of compartments for holding a plurality of cells and a printed circuit board;

said printed circuit board further including a pre-programmed angle sensor chip, pre-programmed IC voice chip and a pre-programmed microcontroller chip;

said device further including an audio enhancement for increasing the volume of said device;

said training device is activated by an on/off switch is positioned at a lower portion of said casing;

a pre-set non-adjustable knob and an adjustment scale positioned on an upper portion of said casing, wherein said pre-programmed microcontroller chip can be repeatedly reset b said non-adjustable knob;

wherein a basketball player wears said device during training, and wherein said non-adjustable knob is positioned up towards said basketball player's fingers and aligned with said basketball player's thumb or little finger, said training device will alert said basketball player when an elbow angle range of said basketball player falls outside of a pre-programmed trip point range of said angle sensor, said pre-programmed IC voice chip is then prompted to verbalize a phrase alerting said basketball player of improper arm positioning.

2. The device of claim 1, wherein said casing is ergonomically designed for best accommodation a basketball player's performance and behavior while reducing discomfort; said casing including a shape selected from the group consisting of: Triangle, Cylinder, Cone, Rectangle, Square, Octagon, Diamond, Pentagon, Cube, Pyramid, and Hexagon.

3. The device of claim 2, wherein said casing is formed from a material consisting of: Magnesium, Foam, Aluminum, Alloy, Wood, Polyethylene, Polypropylene, Polystyrene, Polyvinyl Chloride, Alkyds, Amino Phenolic Resins, Epoxies, Polyurethanes, Acrylonitrile Butadiene Styrene, and Unsaturated Polyesters.

4. The device of claim 1, wherein said sleeve is formed of a stretchy material and includes a hook-and-loop material for attaching said sleeve to a user's arm, and wherein said pocket is made of a sack or a cloth-like material, said cloth-like material selected from the group consisting of: Wool, Silk, Linen, Acetate, Latex, Nylon, Polyester, Rayon, and Spandex.

5. The device of claim 1, wherein said pocket is formed from a material consisting of: Leather, Cotton, Silk, Polyester, Wool, Denim, Suede, Kevlar, Velvet, Satan, Rayon, Khaki, and Spandex.

6. The device of claim 1, wherein said angle sensor chip goes into sleep mode after a predetermined time and is reactivated by movement.

7. The device of claim 1, wherein said On/Off switch is positioned on an outside surface of said casing.

8. The device of claim 1, wherein said audio enhancement comprising a speaker connection used for enhancing the sound of said device.

9. The device of claim 1, wherein said device includes two common single cells producing an electric current for energizing said device.

10. The device of claim, wherein said training device includes no internal moveable parts.

* * * * *